United States Patent [19]

Knight

[11] Patent Number: 4,847,627

[45] Date of Patent: Jul. 11, 1989

[54] COMPACT WAVE ANTENNA SYSTEM

[75] Inventor: George M. Knight, North Hollywood, Calif.

[73] Assignee: Lockheed Corporation, Calabasas, Calif.

[21] Appl. No.: 95,492

[22] Filed: Sep. 8, 1987

[51] Int. Cl.[4] ..... H01Q 1/28

[52] U.S. Cl. ..... 343/705; 343/895

[58] Field of Search ..... 343/705, 708, 713, 895

[56] References Cited

U.S. PATENT DOCUMENTS

| | | | |
|---|---|---|---|
| 2,279,130 | 3/1941 | Bruce | 250/33 |
| 2,963,704 | 12/1960 | Yates et al. | 343/895 |
| 3,039,100 | 6/1962 | Kay | 343/872 |
| 3,245,080 | 4/1966 | Beuvain | 343/708 |
| 3,276,020 | 9/1966 | Maillet | 343/705 |
| 3,518,685 | 6/1970 | Jones, Jr. | 343/708 |
| 3,530,478 | 9/1970 | Corzine et al. | 343/771 |
| 3,633,210 | 1/1972 | Westerman et al. | 343/895 |
| 3,683,281 | 8/1972 | Watts, Jr. | 325/312 |
| 3,713,162 | 1/1973 | Munson et al. | 343/705 |
| 3,811,127 | 5/1974 | Griffee et al. | 343/705 |
| 3,824,600 | 7/1974 | Majkrzak et al. | 343/895 |
| 3,852,756 | 12/1974 | Reese | 343/708 |
| 3,997,900 | 12/1976 | Chin et al. | 343/100 |
| 4,349,824 | 9/1982 | Harris | 343/700 |
| 4,392,139 | 7/1983 | Aoyama et al. | 343/705 |

*Primary Examiner*—Rolf Hille
*Assistant Examiner*—Doris J. Johnson
*Attorney, Agent, or Firm*—L. L. Dachs

[57] ABSTRACT

The invention is a compact wave antenna system for use on an aircraft. The antenna is mounted on a boom made of a dielectric material extending from the rear of the aircraft. The antenna comprises a thin, flat conductor wrapped around the boom. A large, "capacitive hat" is mounted to the extreme rear end of the conductor. The main contributors to the performance is the use of thin, wide conductor design and its relatively long length. The width causes high shunt capacity and high RF current flow to the airframe from all sections of the compact wave conductor topped off the capacitive hat at the end. The thin conductor cross-section minimizes series inductance and improves the flow of RF current. Additional current flows due to the spiral section coupling to sympathetic polarities of the airframe and due to additional radiation from the directional discontinuities.

2 Claims, 5 Drawing Sheets

COMPACT WAVE ANTENNA SYSTEM

TECHNICAL FIELD

The invention relates to the field of antennas and, in particular, to a broadband radio antenna for use on aircraft.

BACKGROUND INFORMATION

Military communication planning is placing increased emphasis on broadband operation. This is particularly true in the high frequency (HF) communication spectrum. Planners are looking towards spread-spectrum and frequency-hopping systems to meet their anti-jamming and low probability of intercept requirements. Because HF is a four octave (2 to 30 Mhz) spectrum, radio frequency changes require large broadband antennas or, where antenna sizes are limited, automatic antenna couplers with near-instantaneous re-tuning capabilities. Additionally, these antennas must not adversely effect the aerodynamics of the aircraft.

Resonant antennas are used when size is a limitation. Wave antennas would be preferable for spread-spectrum and frequency hopping because they are inherently broadband, but conventional versions are several wavelengths long. At the highest HF frequency a five wavelength wave antenna would be 50 meters long and it would be 750 meters long at the lowest HF frequency; far too long for most airborne, ground vehicular, and many fixed shore installations. The specific difference between a wave antenna and resonant antenna is that the incident wave of a resonant antenna is reflected back from its end. The reflected wave sums with the incident wave to form a standing wave and a sinusoidal current distribution results. On a wave antenna, the incident wave is terminated in a characteristic impedance, either by radiation or in a matched resistive load. No reflection results in a traveling wave, constant current distribution along the conductor, and broadband frequency response, long, wire antennas terminate the incident wave by radiative loading when they are greater than five wavelengths. Helical antennas will exhibit constant current characteristics at five wavelengths when the circumference of the helix approaches one wavelength. Conventional wave antennas such as terminated or inverted Vee shape, rhombus and beverage versions, require several wavelengths per leg and usually terminate in non-reactive resistor networks.

The two main characteristics of wave antennas which are important to the needs described above are due to the constant current distribution. First of all constant current distribution provides the highest current-per-unit-length of radiator for a given antenna size. This provides the maximum radiated field intensity for a given transmitter power and antenna size. Secondly, a constant current distribution provides broadband frequency response. When the transmitter output impedance is matched to a constant current antenna the Voltage Standing Wave Ratio (VSWR) will remain low throughout the bandwidth of the termination and matching network. Also, termination and matching networks are amenable to broadband design without being deliberately resistive. The radiation patterns of wave antennas are affected by input frequency changes; however, this is not critical in compact wave antenna applications because the radiation pattern would be dominated by the relatively larger size of the vehicle or airframe portion of the radiating system.

Thus, to achieve practical success depends upon the required operating bandwidth, the RF characteristics of the platform structure within that bandwidth, the VSWR limits of the transmitter, and how well the compact wave antenna design maximizes the efficiency of the radiative termination within its allotted size. When bandwidth requirements are not critical and modern auto-tune couplers are employed requirements can be met and performance improved with smaller, semi-terminated compact wave antennas. Here, the compact wave antenna would be terminated sufficiently to reduce the reflective wave, improve radiation efficiency and improve the probability of successful coupler tuning.

Thus, it is a primary object of the subject invention to provide a compact wave antenna which is lightweight, conformal with low parasitic drag.

It is another object of the subject invention to provide a compact wave antenna which maximizes the aperture of the radiating system.

It is a further object of the subject invention to provide a compact wave antenna which takes advantage of the enhancement produced by the excitation of the various airframe polarities.

It is a still further object of the subject invention to provide a compact wave antenna which provides consistent reliable coupler tuning.

DISCLOSURE OF THE INVENTION

The invention is a compact wave antenna system designed primarily for incorporation on an aircraft. However, it can be used on a ship, ground vehicle or any stationary structure where there is limited space for a full size antenna at the frequencies involved. The antenna is mounted on an extension or boom made of dielectric material from the rear of the aircraft. For example, the magnetic anomaly detector (MAD) boom on the P-3 Orion AEW Aircraft, which is made of fiberglass composite materials. Note that in the AEW configuration the MAD is removed. The antenna is wrapped around the boom in a spiral fashion to provide additional conductor length and omni-polarized excitation of the airframe. The antenna terminates in a large, cup-shaped "capacitive hat" mounted to the extreme rear end of the boom which lowers the resonant frequency of the antenna and causes higher currents to flow in the antenna conductor. The antenna is composed of thin, wide conductor to provide low series inductance and distributed high shunt capacity along the entire conductor.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1 is a partial platform view of the tail section of an aircraft having a magnetic anomaly detector boom extending therefrom.

Illustrated in FIG. 2 is a side elevation view of the rear portion of the aircraft shown in FIG. 1.

Figure 3:
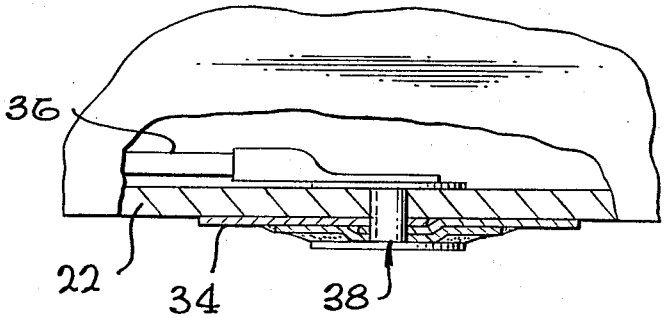
Figure 2:
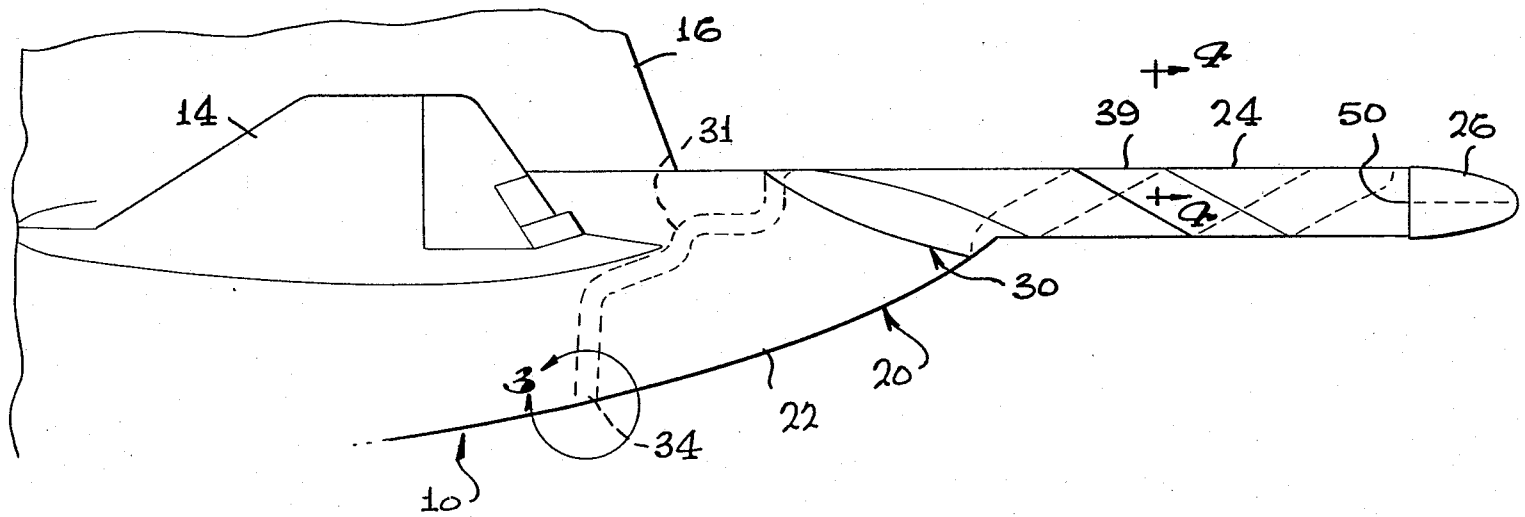

Illustrated in FIG. 3 is an enlarged partial cross-sectional view of a section of the boom shown in FIG. 2 identified by the numeral 3.

Figure 4:
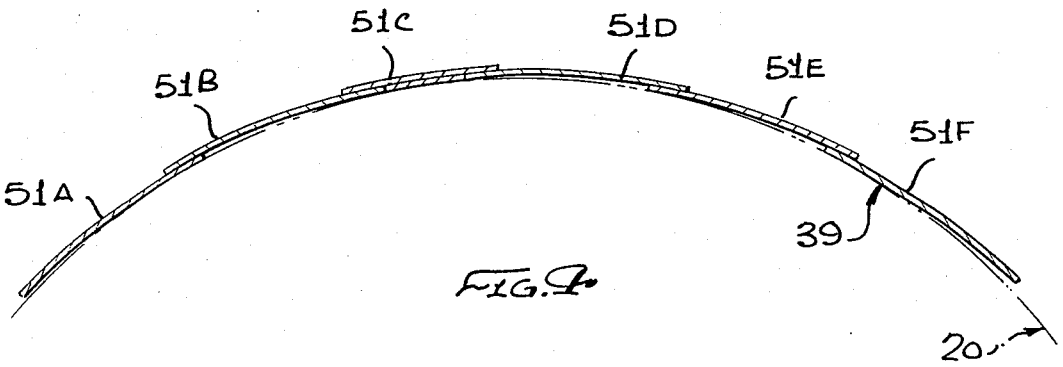

Illustrated in FIG. 4 is a partial cross-sectional view of an antenna shown in FIG. 2 taken along the line 4—4.

Figure 5:
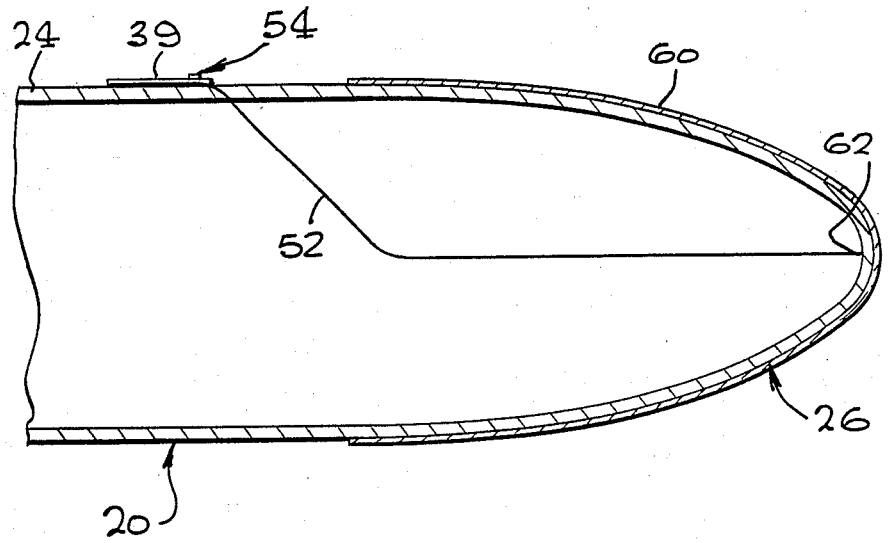

Illustrated in FIG. 5 is an enlarged schematic view of the end of the tail boom shown in FIG. 2, illustrating the connection of the flat section of the antenna to the "hat" section thereof.

Figure 6:
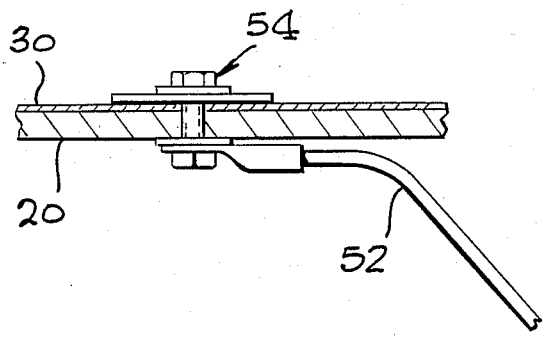

Illustrated in FIG. 6 is an enlarged cross-sectional view of a portion of the schematic view of FIG. 5 showing the coupling of the flat portion of the antenna to the internal cable which, in turn couples to a "capacitive hat" section.

Figure 7:
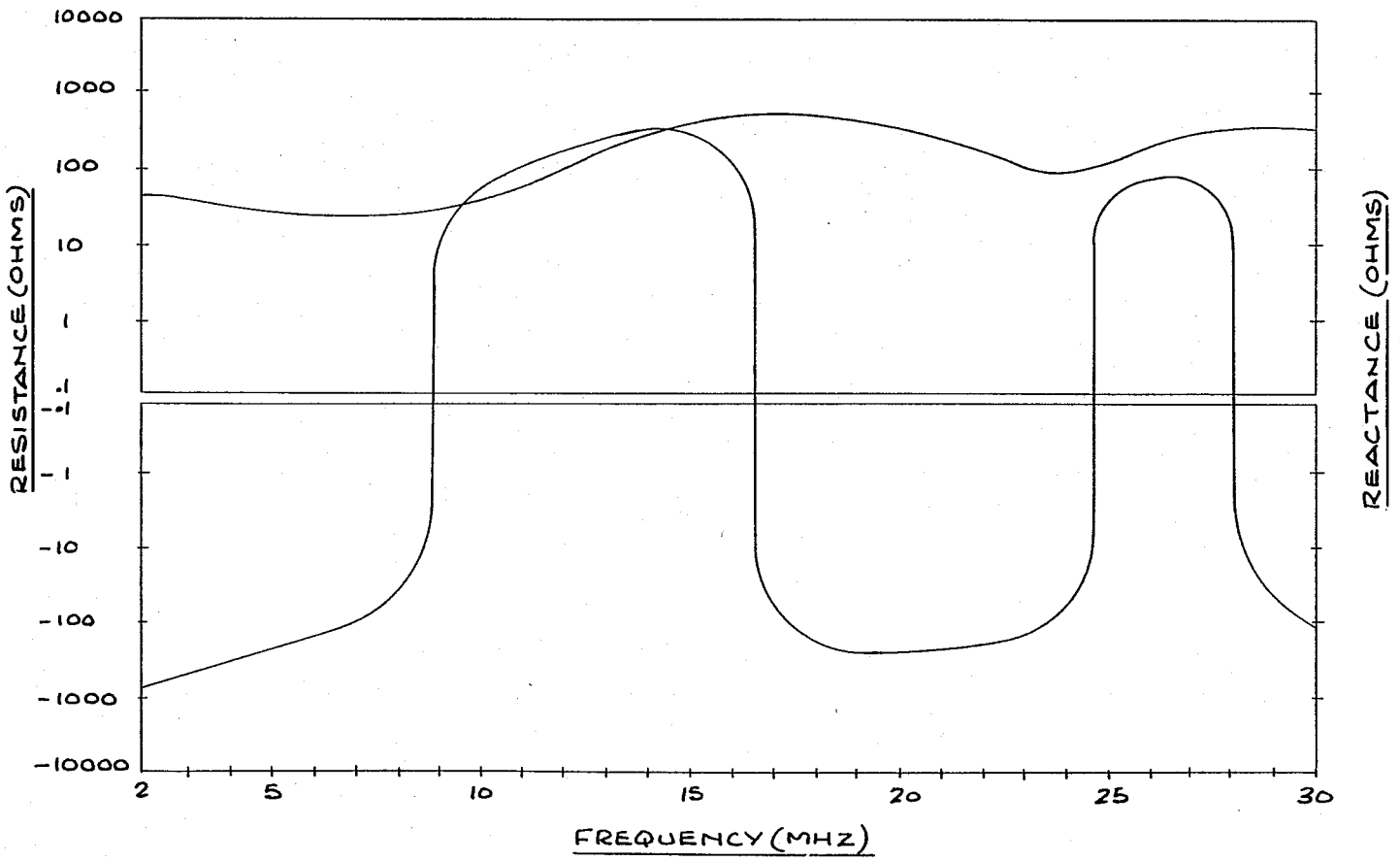

Illustrated in FIG. 7 is a graph of the performance of the subject antenna wherein the impedance is plotted against frequency.

Figure 8:
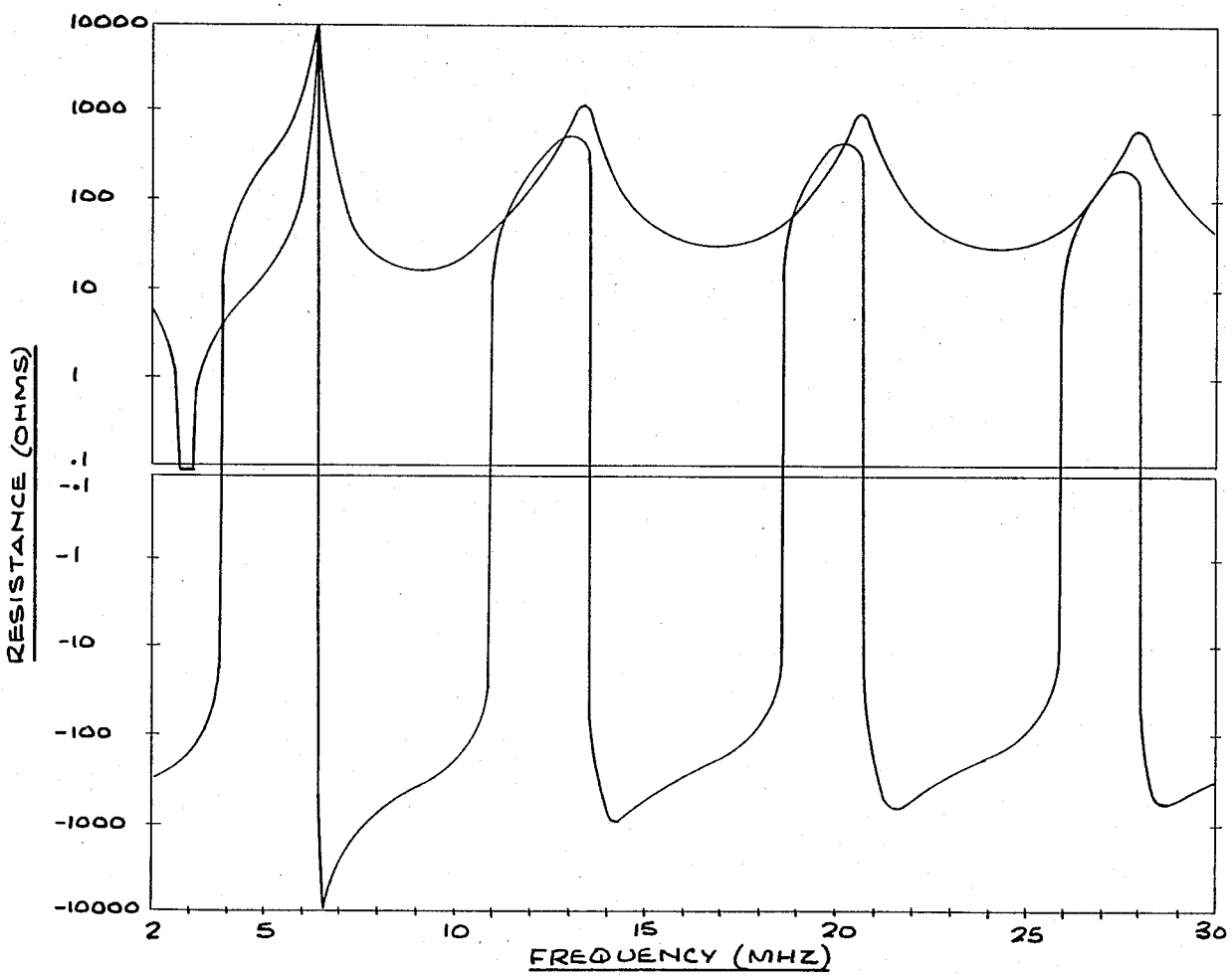
FIG. 8 PRIOR ART

Illustrated in FIG. 8 is a graph of a conventional long wire antenna wherein the impedance is plotted against frequency.

BEST MODE FOR CARRYING OUT THE INVENTION

The semi-terminated compact wave antenna was primarily designed for use on the P-3 Orion, turbo-prop, long range patrol aircraft. The conventional P-3 aircraft, in its anti-submarine warfare configuration, incorporated a magnetic anomaly detector (MAD) mounted within a boom extending from the rear of the aircraft and used a conventional wire antenna on the upper portion of the aircraft for HF radio transmission. However, when the aircraft was converted to an airborne early warning and control (AEW&C) aircraft, a radar rotodome was pylon mounted to the top of the fuselage interfering with the conventional wire antenna. However, there was no longer a requirement for the installation of a MAD in the tail boom, although, the rear mounted radar remained mounted therein. Therefore, the MAD boom, which is a hollow composite structure made primarily of dielectric materials, became an ideal location for the installation of the HF antenna. A conventional antenna would not easily mount on the MAD boom because of its limited size. Thus, in the following detailed description of a preferred embodiment the compact wave antenna system is configured for incorporation on the MAD boom of the P-3 aircraft. However, it must be understood that the antenna system is not limited to such an installation and would have application on other aircraft, ships, land vehicles and stationary structures where space for antennas is limited.

Figure 1:
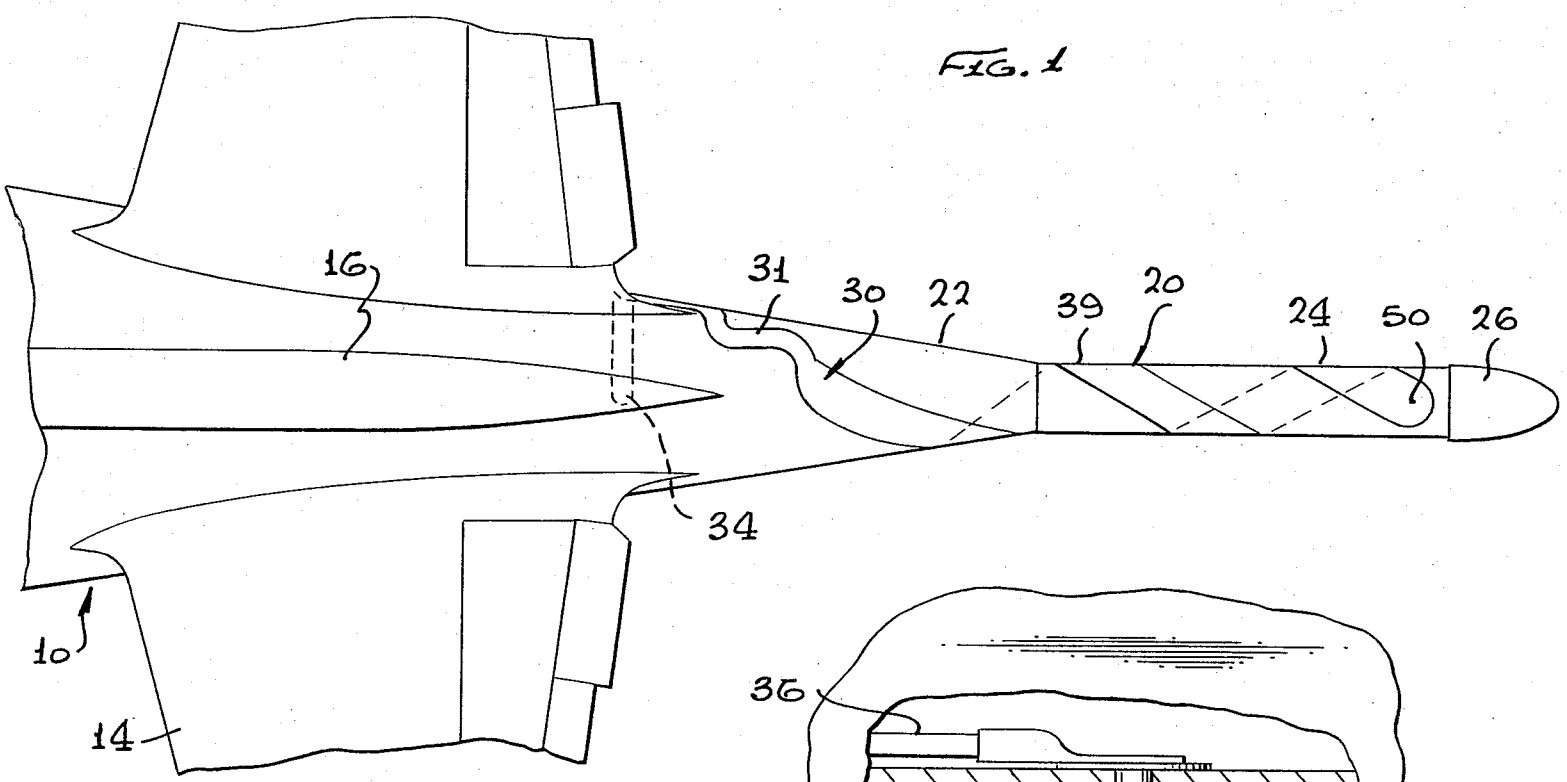

Illustrated in FIG. 1 is a partial platform view of the tail section of the P-3 aircraft, generally indicated by numeral 10 while illustrated in FIG. 2 is a side view of the same portion of the aircraft. Partially shown are the horizontal stabilizer 14 and vertical stabilizers 16. Mounted to the aft end of the tail section is a MAD boom 20. As previously mentioned for the AEW&C mission of the P-3 aircraft the MAD is removed. The boom 20 has a transition section 22 approximately 10.5 feet long in which is mounted a radar antenna (not shown). The transition section 22 blends into a circular section 24, 9.5 feet in length. The circular section 24 with a diameter of 15 inches and, thus, is significantly smaller in cross-section than the transitions section 22. The boom terminates in a curved cone section 26 approximately 30 inches long. Wrapped around the boom 20 is the subject compact wave antenna generally indicated by numeral 30.

Still referring to FIGS. 1 and 2 and additionally to FIG. 3, which is an enlarged cross-sectional view of the circular section 24 of the boom 20, it can be seen that the antenna 30 includes a first portion 31 which starts at the transition section 22. The first end 34 of the antenna 30 which is approximately 0.005 inch thick and 5 inches wide is coupled to the antenna lead 36 by means of a fastener assembly 38 which is soldered thereto. The first portion 31 of the antenna 30 is bonded to the transition section 22 and spirally winds thereabout. Please note that the first portion 31 of the antenna 30 also serpentines around the transition section 22 to avoid interfering with the radar antenna mounted therein (not shown) to the top of the transition section 22 where it smoothly translates to a 12 inch wide second portion 39. This occurs some 70 inches from the front of the boom 20. The second portion 39 of the antenna 30 thereafter spirally winds about the remainder of the circular portion 24 ending at a point 50, approximately 10.6 inches from the cone section 26. The pitch of the spiral is approximately 60.9 inches per revolution and, thus, the overall length of the spiral portion 39 is 10.5 feet long.

Referring to FIG. 4 which is a cross-sectional view of the first portion 31 of the antenna 30 taken along the line 4—4 shown in FIG. 2, it can be seen that the spiral portion 39 of the antenna 30 comprises five strips 51A–51F of overlapping copper soldered together. However, the antenna could be made of a single strip of copper. The thickness of the strips is 0.005 inch soft copper tape. This is approximately three times the skin depth (for 2 to 30 Mhz RF). Now referring to FIG. 6 which is a simplified drawing of the end of the boom 20, (particularly showing cone section 26) and to FIG. 5 which is a detailed partial cross-sectional view of the area around point 50, it can be seen that the second portion 39 of the antenna 30 is electrically coupled to a lead wire 52 (one-fourth inch diameter copper wire) by fastener assembly 54. The lead wire 52 is then in turn, coupled to a conductive cup (more commonly called a "capacitive hat") 60 at its center 62, also by means of a fastener assembly (not shown). The hat 60 extends back over the cone section 26 but ends some 9.6 inches from the point 50 (rounded end of spiral portion). It is also constructed of conductive strips of 0.005 inch copper sheet soldered together. The 0.005 thickness is three times the skin depth i.e., the depth from the surface of the conductor to which the current essentially flows at the frequencies within the band width. The hat 60 can also be made of a single piece of copper or the like.

Having described the physical characteristics of a preferred embodiment of the antenna system it is now necessary to explain why the antenna provides such unexpected improved performance. The key electromagnetic characteristics needed to meet the electrical requirements is the RF coupling to the airframe and to space. The main contributing feature to achieving this is the thin, wide conductor design and its length and its spiral shape topped off by the capacitive hat at the tip. The width causes high shunt capacity and high RF current flow to the airframe from all sections of the compact wave conductor further enhanced by the spiral discontinuity and the resulting vari-polar radiation/-coupling to the various polarities in the airframe. The thin conductor's cross-section also minimizes series inductance and improves the flow of RF current. Note that the spiral section is not a helical antenna because of its extremely small diameter in terms of wavelength. Furthermore, because these currents are not confined to the small area across the feed point gap, as in conventional tail cap antennas, the radiation field intensity is significantly improved.

Test Results

FIG. 7 is a graph of the measured impedance versus HF operating frequency of the compact wave antenna. The antenna is obviously "coupler friendly" for the resistive component starts at 30 Ohms at 2 Mhz and ranges between 12 and 700 Ohms throughout the 2 to 30 Mhz RF spectron. Furthermore, the reactive component starts at minus 800 Ohms and ranges between there and plus 300 Ohms with a smooth transmissions in direction and frequency. It can be concluded that the compact wave antenna has moderate (Q) and high radiation efficiency, overall performance of antenna is well above that which would be expected from the simple summary of the expected performance of the individual features, i.e., tail mounting, spirals, hat section, flat conductor, etc.

For comparison purposes, illustrated in FIG. 8 is a graph of the performance of a 65 foot long, horizontal wire type antenna. Here it can be seen that the resistive component becomes useful at 3 Mhz and ranges between 10 and 5,000 Ohms and the reactive component starts at minus 600 Ohms and ranges from minus 8,000 to plus 10,000 Ohms. Clearly the compact wave antenna is superior. In-flight comparisons showed signal strength improvements by factors of 5 to 10 (7 to 10 db) on transcontinental and transoceanic paths over the wire antenna described above.

Summary of the Advantages (1) The radiation aperture of the airframe-antenna system is increased by 20 percent.

(2) The radiation field and efficiency is increased.

(3) The radiation resistance is increased.

(4) The stored energy field (reactance) is reduced by the distributed shunt capacity.

(5) The "Q" is reduced, increasing the bandwidth and the probability of successful coupler tuning.

(6) The various airframe polarities are excited, smoothing the radiation pattern and making it more omnidirectional.

(7) The thin, flat configuration does not significantly effect aerodynamics.

(8) The spiral shaped directional discontinuities cause increased radiation efficiency.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

Industrial Applicability

The antenna has applicability to radio transmitting equipment and in particular, radio equipment in airborne vehicles where length and space are limited.

I claim:

1. A radio frequency antenna system for an aircraft for transmitting radio frequency waves of a given band width comprising:

a boom substantially made of dielectric material having a first end attached to the tail of the aircraft and a second end extending rearward from the tail;

a flat conductor having first and second ends, said conductor spirally wound about said boom with said first end terminated in proximity to said first end of said boom and said second end terminated in proximity to said second end of said boom, said flat conductor spiraled in a manner to promote multiple polarity radiation and creating directional discontinuities in the path of said radio frequency current flowing towards said second end of said boom; and a cup shaped capacitive cap mounted on said second end of said boom, the open end of said capacitive cup facing the aircraft and positioned in a non-overlapping relationship with said flat conductor, the closed end of said cap physically and electrically connected to said second end of said flat conductor.

2. The antenna system as set forth in claim 1, wherein said flat conductor and said capacitive hat have a thickness of approximately three times the skin depth of the radio waves of the given band width.

* * * * *